US008950188B2

(12) United States Patent
Stewart

(10) Patent No.: US 8,950,188 B2
(45) Date of Patent: Feb. 10, 2015

(54) TURNING GUIDE FOR COMBUSTION FUEL NOZZLE IN GAS TURBINE AND METHOD TO TURN FUEL FLOW ENTERING COMBUSTION CHAMBER

(75) Inventor: Jason Thurman Stewart, Greer, SC (US)

(73) Assignee: General Electric Company, Schenectady, NY (US)

( * ) Notice: Subject to any disclaimer, the term of this patent is extended or adjusted under 35 U.S.C. 154(b) by 824 days.

(21) Appl. No.: 13/229,115

(22) Filed: Sep. 9, 2011

(65) Prior Publication Data

US 2013/0061594 A1 Mar. 14, 2013

(51) Int. Cl.

| | |
|---|---|
| ***F23R 3/10*** | (2006.01) |
| ***F23R 3/04*** | (2006.01) |
| ***F23R 3/34*** | (2006.01) |
| ***F23R 3/26*** | (2006.01) |

(52) U.S. Cl.

CPC .... *F23R 3/10* (2013.01); *F23R 3/26* (2013.01)
USPC ..... 60/747; 60/751; 60/760; 239/405

(58) Field of Classification Search

USPC ..... 60/740, 733, 737, 746–748, 751, 760; 239/399, 403, 405, 406, 423, 424
See application file for complete search history.

(56) References Cited

U.S. PATENT DOCUMENTS

| | | | |
|---|---|---|---|
| 3,042,078 | A | 7/1962 | Rosell |
| 3,614,283 | A | 10/1971 | Morgan |
| 3,747,598 | A | 7/1973 | Cowane |
| 4,133,038 | A | 1/1979 | Niemi |
| 4,196,226 | A | 4/1980 | Benjamin et al. |
| 4,260,591 | A | 4/1981 | Benjamin et al. |
| 4,335,154 | A | 6/1982 | Benjamin et al. |
| 4,619,833 | A | 10/1986 | Anderson |
| 4,715,234 | A | 12/1987 | Allen et al. |
| 4,911,007 | A | 3/1990 | Churchill et al. |
| 5,341,848 | A | 8/1994 | Laws |
| 5,370,001 | A | 12/1994 | LaBrecque et al. |
| 5,392,815 | A | 2/1995 | Stuart |
| 5,448,921 | A | 9/1995 | Cage et al. |
| 5,483,829 | A | 1/1996 | Caron |
| 5,495,872 | A | 3/1996 | Gallagher et al. |
| 5,529,093 | A | 6/1996 | Gallagher et al. |
| 5,537,868 | A | 7/1996 | Shofner et al. |
| 5,576,500 | A | 11/1996 | Cage et al. |
| 5,592,964 | A | 1/1997 | Traylor |
| 5,596,969 | A | 1/1997 | Lipinski |
| 5,628,182 | A | 5/1997 | Mowill |
| 5,685,139 | A | 11/1997 | Mick et al. |
| 5,728,942 | A | 3/1998 | Boger |
| 5,728,950 | A | 3/1998 | Boulanger |
| 5,736,651 | A | 4/1998 | Bowers |
| 5,762,107 | A | 6/1998 | Laws |
| 5,780,737 | A | 7/1998 | Wible et al. |

(Continued)

FOREIGN PATENT DOCUMENTS

| | | |
|---|---|---|
| JP | 8-270947 | 10/1996 |

*Primary Examiner* — Andrew Nguyen
(74) *Attorney, Agent, or Firm* — Nixon & Vanderhye P.C.

(57) ABSTRACT

A fuel nozzle assembly for a gas turbine, the assembly including: a cylindrical center body; a cylindrical shroud coaxial with and extending around the center body, and a turning guide having an downstream edge extending in a passage between the center body and an inlet to the shroud, wherein the turning guide extends only partially around the center body.

20 Claims, 9 Drawing Sheets

(56) References Cited

U.S. PATENT DOCUMENTS

| | | | | |
|---|---|---|---|---|
| 5,816,907 | A | 10/1998 | Crockett | |
| 5,869,772 | A | 2/1999 | Storer | |
| 5,889,213 | A | 3/1999 | Guizot et al. | |
| 5,913,250 | A | 6/1999 | Wible | |
| 5,935,426 | A | 8/1999 | Giordano et al. | |
| 5,959,216 | A | 9/1999 | Hocquet et al. | |
| 6,047,903 | A | 4/2000 | Meyer | |
| 6,048,194 | A | 4/2000 | Pfefferie et al. | |
| 6,065,455 | A | 5/2000 | McLean | |
| 6,128,072 | A | 10/2000 | Kiel et al. | |
| 6,145,544 | A | 11/2000 | Dutertre et al. | |
| 6,149,801 | A | 11/2000 | Giordano et al. | |
| 6,155,819 | A | 12/2000 | Etemad et al. | |
| 6,186,179 | B1 | 2/2001 | Hill | |
| 6,199,434 | B1 | 3/2001 | Cornil et al. | |
| 6,267,013 | B1 | 7/2001 | Stark et al. | |
| 6,270,337 | B1 | 8/2001 | Etemad et al. | |
| 6,270,493 | B1 | 8/2001 | Lalonde et al. | |
| 6,275,284 | B1 | 8/2001 | Kiel et al. | |
| 6,282,904 | B1 | 9/2001 | Kraft et al. | |
| 6,284,129 | B1 | 9/2001 | Giordano et al. | |
| 6,289,934 | B1 | 9/2001 | Welker | |
| 6,340,243 | B1 | 1/2002 | Deane et al. | |
| 6,340,695 | B1 | 1/2002 | Gervaia | |
| 6,363,724 | B1 | 4/2002 | Bechtel et al. | |
| 6,429,020 | B1 | 8/2002 | Thornton et al. | |
| 6,438,961 | B2 | 8/2002 | Tuthill et al. | |
| 6,439,062 | B2 | 8/2002 | Stark et al. | |
| 6,439,267 | B2 | 8/2002 | Welker | |
| 6,446,439 | B1 | 9/2002 | Kraft et al. | |
| 6,453,673 | B1 | 9/2002 | Bechtel et al. | |
| 6,460,326 | B2 | 10/2002 | Bechtel et al. | |
| 6,460,345 | B1 | 10/2002 | Beebe et al. | |
| 6,472,186 | B1 | 10/2002 | Quintanar et al. | |
| 6,473,171 | B1 | 10/2002 | Buttry et al. | |
| 6,494,105 | B1 | 12/2002 | Gallagher | |
| 6,517,707 | B2 | 2/2003 | Giordano et al. | |
| 6,532,742 | B2 | 3/2003 | Scarinci et al. | |
| 6,533,065 | B2 | 3/2003 | Zanker | |
| 6,564,651 | B1 | 5/2003 | Bowers | |
| 6,588,889 | B2 | 7/2003 | Jeanmaire | |
| 6,612,187 | B1 | 9/2003 | Lund | |
| 6,629,819 | B1 | 10/2003 | Brown et al. | |
| 6,634,175 | B1 * | 10/2003 | Kawata et al. | 60/746 |
| 6,647,806 | B1 | 11/2003 | Estrada et al. | |
| 6,651,514 | B2 | 11/2003 | Zanker | |
| 6,669,118 | B2 | 12/2003 | Webster | |
| 6,675,581 | B1 | 1/2004 | Stuttaford et al. | |
| 6,698,207 | B1 | 3/2004 | Wiebe et al. | |
| 6,701,963 | B1 | 3/2004 | Hill | |
| 6,755,978 | B2 | 6/2004 | Oddie | |
| 6,772,583 | B2 | 8/2004 | Bland | |
| 6,786,046 | B2 | 9/2004 | Wiebe et al. | |
| 6,786,047 | B2 | 9/2004 | Bland et al. | |
| 6,796,173 | B1 | 9/2004 | Lajoie et al. | |
| 6,848,260 | B2 | 2/2005 | North et al. | |
| 6,851,322 | B2 | 2/2005 | Gallagher | |
| 6,858,067 | B2 | 2/2005 | Burns et al. | |
| 6,868,741 | B2 | 3/2005 | Harman | |
| 6,886,346 | B2 | 5/2005 | Sobieski et al. | |
| 6,898,986 | B2 | 5/2005 | Daniel et al. | |
| 6,915,636 | B2 | 7/2005 | Stuttaford et al. | |
| 6,926,821 | B2 | 8/2005 | Giordano et al. | |
| 6,983,600 | B1 | 1/2006 | Dinu et al. | |
| 6,993,916 | B2 | 2/2006 | Johnson et al. | |
| 7,007,477 | B2 | 3/2006 | Widener | |
| 7,008,644 | B2 | 3/2006 | Batycky et al. | |
| 7,051,530 | B2 | 5/2006 | Blomeyer | |
| 7,770,395 | B2 * | 8/2010 | Tanimura et al. | 60/737 |
| 2003/0051478 | A1 | 3/2003 | Matsuyama et al. | |
| 2007/0125092 | A1 | 6/2007 | Wolfe et al. | |
| 2007/0277530 | A1 | 12/2007 | Dinu et al. | |
| 2009/0173074 | A1 * | 7/2009 | Johnson et al. | 60/737 |
| 2010/0229556 | A1 * | 9/2010 | Dinu | 60/734 |
| 2010/0236247 | A1 | 9/2010 | Davis, Jr. et al. | |
| 2011/0005229 | A1 | 1/2011 | Venkataraman et al. | |

* cited by examiner

TURNING GUIDE FOR COMBUSTION FUEL NOZZLE IN GAS TURBINE AND METHOD TO TURN FUEL FLOW ENTERING COMBUSTION CHAMBER

The invention relates to fuel combustion in a gas turbine, and particularly relates to guiding compressed air to a combustion zone in a combustor.

BACKGROUND OF THE INVENTION

A gas turbine combustor mixes large quantities of fuel and compressed air, and burns the resulting air and fuel mixture. Conventional combustors for industrial gas turbines typically include an annular array of cylindrical combustion "cans" in which air and fuel are mixed and combustion occurs. Compressed air from an axial compressor flows into the combustor. Fuel is injected through fuel nozzle assemblies that extend into each can. The mixture of fuel and air burns in a combustion chamber of each can. The combustion gases discharge from each can into a duct that leads to the turbine.

Pressurized air from the compressor enters a combustion can at the back end of the can, which is the same end from which hot combustion gases flow from the can to the turbine. The compressed air flows through an annular duct formed between a cylindrical wall of the can and an inner cylindrical combustion liner. The relatively cool compressed air cools the wall of the liner as the hot combustion gas flows through the interior of the liner. The hot combustion gas flows in a generally opposite direction to the flow of the compressed air through the duct.

As the compressed air reaches the head-end of the combustor can, the air is turned 180 degrees to enter one of the fuel nozzles. To enter the outer fuel nozzles the compressor air makes a tight and quick reversal of flow direction. This abrupt turn can create low velocity flow zones in the air while other zones of the air flow are at significantly higher velocities. The occurrence of low velocity flows is most acute as the air enters the outer fuel nozzles which are closest to the double walled flow path in the combustion chamber for compressed air.

Uniform flow velocities through a fuel nozzle are desired to provide uniform mixing of the air and fuel, and uniform combustion. Zones of low velocity airflow in the fuel nozzle also pose a flame holding risk inside the nozzle as low velocity zones provide an area for a flame to anchor inside the fuel nozzle. A flame in the fuel nozzle can destroy the hardware of the nozzle. In addition, low velocity air flows can cause localized variations in the air and fuel mixture. These variations can include regions where the fuel and air mixture is too rich resulting in too high combustion temperatures and excessive generation of nitrous oxides (NOx). There is a long felt desire to hold a steady flame in a combustor can, reduce NOx emissions from combustion in a gas turbine and maintain uniform airflow velocities through the fuel nozzles.

BRIEF DESCRIPTION OF THE INVENTION

A fuel nozzle assembly has been conceived for a gas turbine, the assembly including: a cylindrical center body; a cylindrical shroud coaxial with and extending around the center body, and a turning guide having an downstream edge extending into the inlet of a passage between the center body and the shroud, wherein the turning guide extends only partially around the center body.

The turning guide may be a thin sheet shaped to conform to an inlet region of the shroud. The turning guide may have a wide mouth curved inlet region and a generally straight outlet region. The turning guide may be mounted to the shroud or center body by a rib or post. The turning guide may extend in an arc around the fuel nozzle, and the arc may be in a range of 200 degrees to 35 degrees. The turning guide may be on a side of the shroud adjacent an outer doubled-walled annular flow duct through which compressor air passes and is turned radially inward towards the assembly.

A combustion chamber has been conceived for a gas turbine comprising: an annular flow duct through which pressurized air flows in a direction opposite to a flow of combustion gases formed in the chamber; an end cover assembly having an inside surface; a radially inward turn in the flow duct proximate to the inside surface of the end cover assembly; at least one fuel nozzle assembly including a cylindrical center body, a cylindrical shroud coaxial with and extending around the center body, and a turning guide having an downstream edge extending towards a passage between the center body and the shroud, wherein the turning guide extends only partially around the center body, and the turning guide is aligned and proximate to an outlet of the annular flow duct such that the turning guide directs air from the annular flow duct into the passage between the center body and the shroud. The turning guide may be on a side of the shroud adjacent the annular flow duct.

A method has been conceived to direct pressurized air into an air flow duct of a fuel nozzle assembly in a combustion chamber, the method comprising: moving pressurized air in a first direction through an annular duct in the combustion chamber and turning the air radially inward from the duct towards the fuel nozzle; the turned pressurized air flowing into a passage between a cylindrical shroud and a center body of the fuel nozzle assembly; as the turned pressurized air flows into the passage, the air is directed by a turning guide having an inlet edge aligned with the turned air flowing from the annular duct and an outlet edge aligned with the passage, wherein the turning guide extends only partially around the center body.

The turning guide may be adjacent the outlet of the annular duct and directs air entering the passage at a location on a side of the center body opposite to the annular duct. The turning guide may be proximate to the inlet to the shroud and the directed air is air flowing near the inlet to the shroud. The turning guide may increase the velocity of air flowing into a radially outward portion of the passage. The turning guide may direct the turned air into a narrow gap between the turning guide and an inlet portion of the shroud, wherein the inlet portion has a wide mouth and the turning guide directs the turned air into the narrow gap between the turning guide and the wide mouth of the shroud.

DETAILED DESCRIPTION OF THE INVENTION

Figure 1:
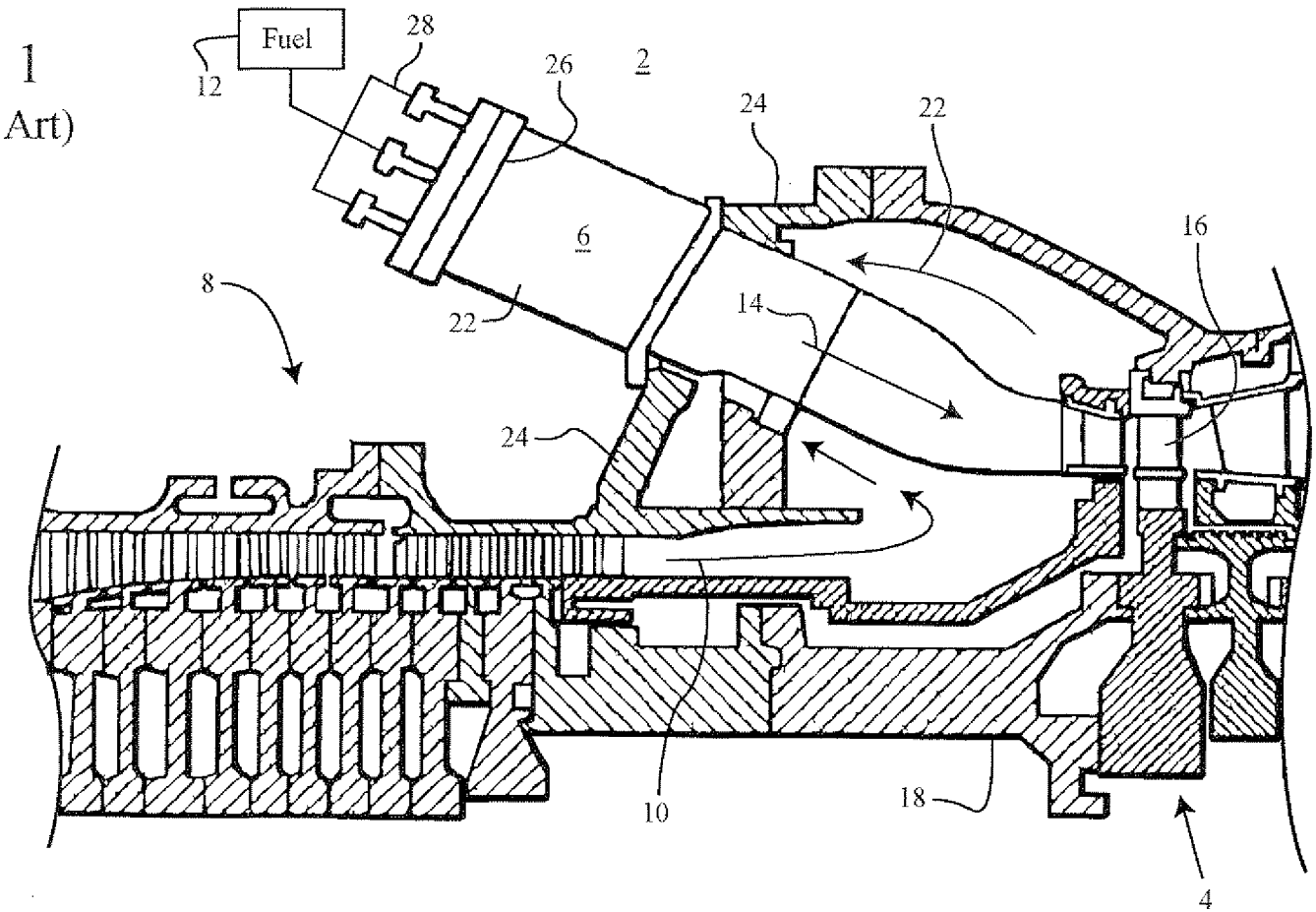
Fig. 1 (Prior Art)
FIG. 1 is a diagram of a conventional combustion chamber in an industrial gas turbine, wherein the gas turbine is shown in cross-section.

FIG. 1 is side view, showing in partial cross section, a conventional gas turbine engine 2 including an axial turbine 4, an annular array of combustion chambers 6, and an axial compressor 8 which generates compressed air 10 ducted to the combustion chambers. Fuel 12 is injected into the combustion chambers and mixes with the compressed air. The air fuel mixture combusts in the combustion chambers and hot combustion gases 14 flow from the chambers to the turbine to drive the turbine buckets 16 to rotate the turbine 4. The rotation of the turbine turns the compressor via the shaft 18 connecting the turbine and compressor. The rotation of the compressor generates the compressed air for the combustion chambers.

Figure 2:
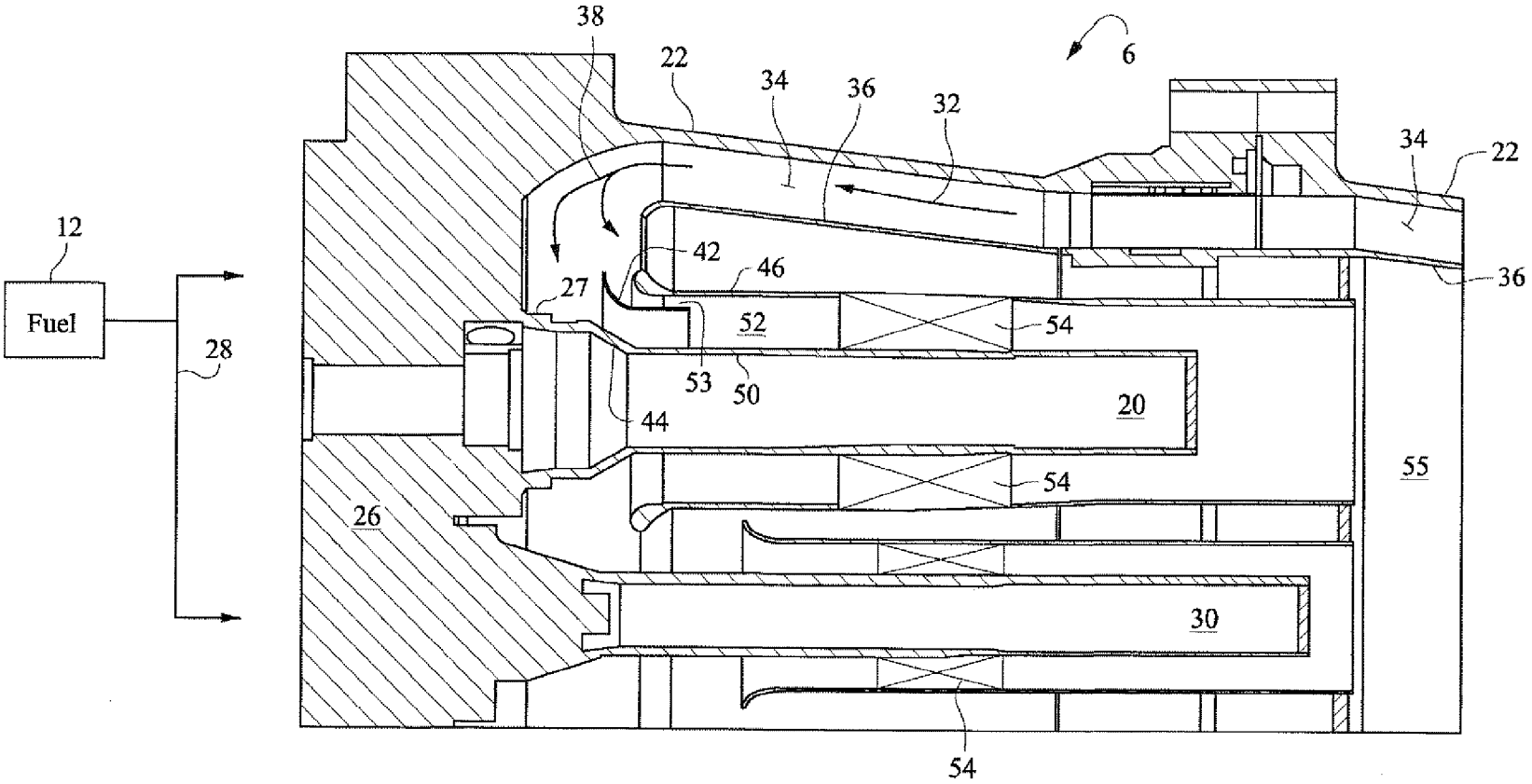
FIG. 2 is a cross-sectional diagram of a portion of a combustion chamber showing the flow path of combustion air through the double-wall of the combustion chamber and turning into an outer fuel nozzle assembly.

FIG. 2 is a cross sectional drawing of a portion of a combustion chamber 6 to show a fuel nozzle assemblies 20. Each combustion chamber 6, also referred to as a "can", includes a substantially cylindrical sleeve 22 secured to the casing 24 of the gas turbine near the discharge end of the compressor. The forward end of the combustion can is closed by an end cover assembly 26 which may be coupled to fuel supply tubes, manifolds and associated valves 28 for feeding gas or liquid fuel 12 to the fuel nozzles of each combustion chamber. The end cover assembly 26 supports a circular array of the fuel nozzle assemblies 20 around a center fuel nozzle assembly 30 housed within the cylindrical sleeve 22.

Pressurized air 10 enters an end of the combustion chamber 6 and flows (see arrow 32) through an annular duct 34 formed between a cylindrical sleeve 22 and an inner cylindrical liner 36 of the chamber 6. The pressurized air 32 flows through the duct 34 towards the end cover assembly 26 in a flow direction opposite to the flow of combustion gases formed in the chamber. The pressurized air is turned by an annular portion of the duct 34 which may be U-shaped 38 in cross-section.

To assist in the turning of the air flow, a turning guide 42 is positioned on each of the fuel nozzle assemblies 20 and near the outlet of the U-shaped portion 38 of the air duct 34. The turning guide 42 may be mounted to be proximate to a rear collar 44 of the fuel nozzle.

Figure 3:
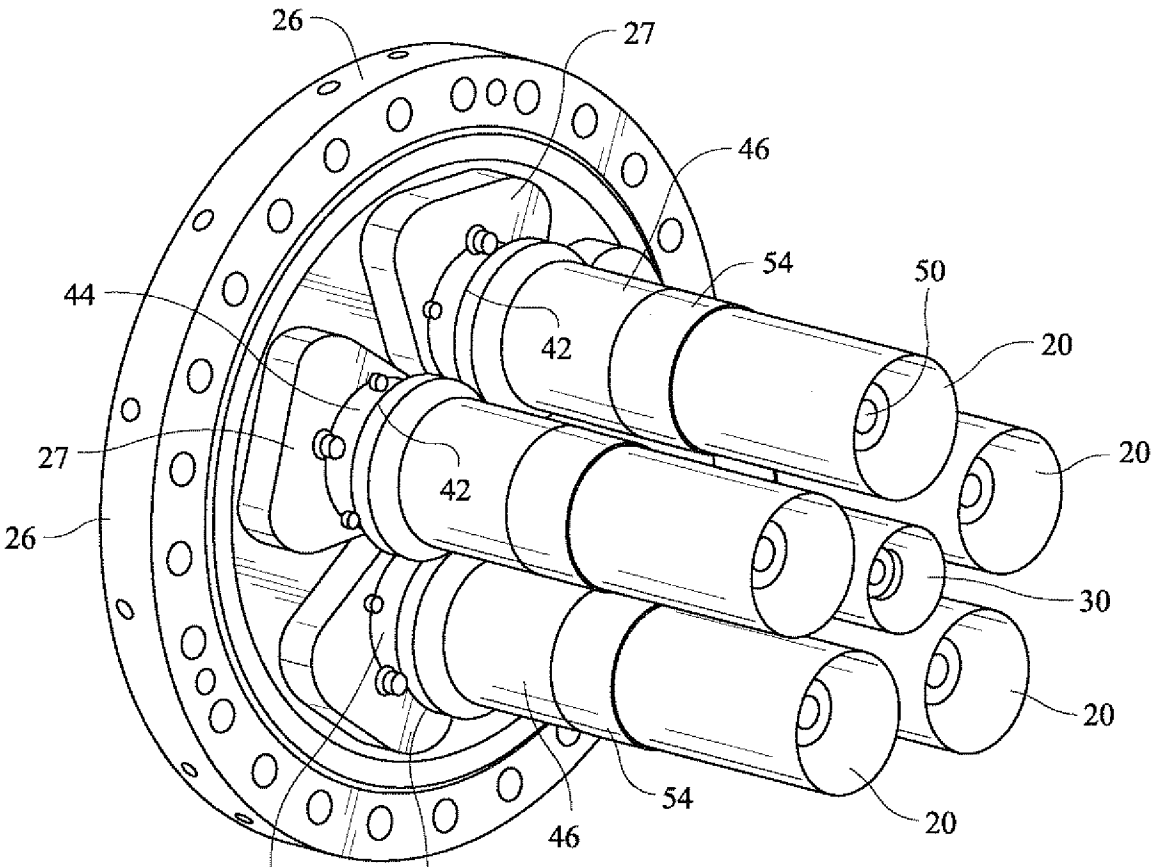
FIG. 3 is a perspective view of an annular array of fuel nozzle assemblies, arranged around a center fuel nozzle assembly.

FIG. 3 is a perspective view of an annular array of fuel nozzle assemblies 20, referred to as the outer fuel nozzle assemblies, arranged around a center fuel nozzle assembly 30. The fuel nozzle assemblies 20, 30 are attached at their rear collars 44 to flanges 27. The flanges are mounted to the end cover assembly 26 For each of the outer fuel nozzle assemblies 20, a turning guide 42 is positioned between its fuel nozzle assembly and the U-shaped end 38 of the annular duct 34 shown in FIG. 2. As shown in FIG. 3, the turning guides are generally positioned at the periphery of a circle formed by the arrangement of outer fuel nozzle assemblies 20 on the end cover assembly 26.

Figure 4:
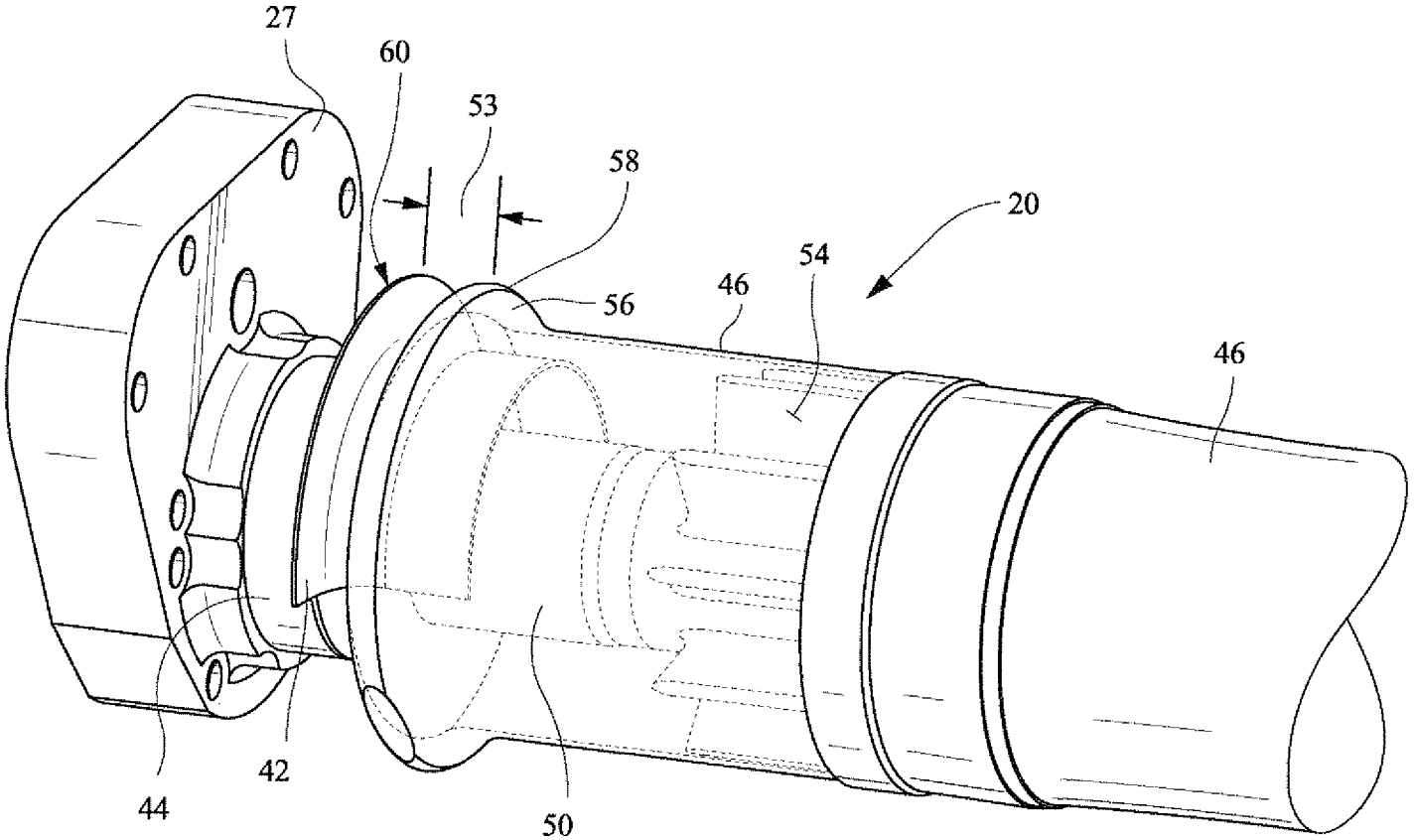
FIG. 4 is a perspective view of the side of an outer fuel nozzle assembly with a portion of the shroud is transparent to show the turning guide.

FIG. 4 is a side view of an outer fuel nozzle assembly 20 with a portion of the shroud 46 transparent to provide a better view of the turning guide 42. The turning guide and center body are show in dotted lines. The turning guide 42 is mounted adjacent the collar 44 of the fuel nozzle assembly. The shroud may have an annular wide-mouth inlet 56. The turning guide 42 may fit partially in the wide-mouth inlet of the shroud. The inlet of the turning guide extends axially out of the shroud inlet and radially outward such that the outer peripheral rim 58 of the wide-mouth inlet 56 is substantially the same radial distance from the axis of the fuel nozzle assembly as the inlet rim 60 of the turning guide.

The rear collar 44 connects the fuel nozzle assembly to a flange 27 which is attached to the end cover assembly 26. The collar may be brazed or welded to a flange 27. The flange 27 may be bolted to the end cover 26.

The turning guide may 42 have a cross-sectional shape conforming to the end of the U-shaped portion 38 of the annular duct. The turning guide 42 may extend in an arc partially around the circumference of the collar 44, such as 180 degrees around the collar. The arc of the turning guide may be in a range of 35 to 200 degrees. The upstream end of the turning guide 42 may extend, at least partially, into the U-shaped portion 38 of the flow duct. The downstream end of the turning guide may be aligned with the inlet of the annular duct 52 between the cylindrical shroud 46 and center body 50. The turning guide may extend partially into the annular duct 52. The downstream end of the turning guide may be radially inward of the shroud 46 such that a gap 53 exits between the shroud and the downstream end of the turning guide. The gap is at the radially outer region of the annular duct 52. Air flowing on the radially outer surface of the turning guide moves into the gap to ensure an air velocity at the radially outer region of the annular duct.

The turning guide 42 assists in providing a uniform flow of the pressurized air being turned into the fuel nozzle assemblies and cylindrical liner 36. The turning guide forms a flow path that increases the velocity of the pressurize air flow near the radially outer part of the shroud 46. The increase in the air velocity due to the turning guide suppresses the tendency of relatively low velocity air flows forming at the outer portion of the shroud. Using the turning guide to increase the flow velocity at the radially outer portion of the annular duct 52 creates a more uniform flow velocity through the entire fuel nozzle.

Air flow having a uniform velocity in the fuel nozzle promotes uniform fuel air mixing and promotes flame holding resistance in the fuel nozzle.

The air flowing through the annular duct 52 mixes with fuel entering the duct from the swirl vanes 54. The air-fuel mixture passing through the annular duct 52 is swirled by swirl vanes 54. The swirl vanes may be a generally cylindrical device mounted between the center body and shroud. The spiral flow induced by the swirl vanes promotes mixing of air and fuel in the duct 52. The mixture of fuel and air flows from the end of the duct 52 to the combustion zone 55 of the combustion chamber. The mixture of fuel and compressed air combust in the combustion zone and the combustion gases flow (see combustion flow arrow 14 in FIG. 1) from the combustion chamber to the buckets 16 in the turbine 4.

Figure 5:
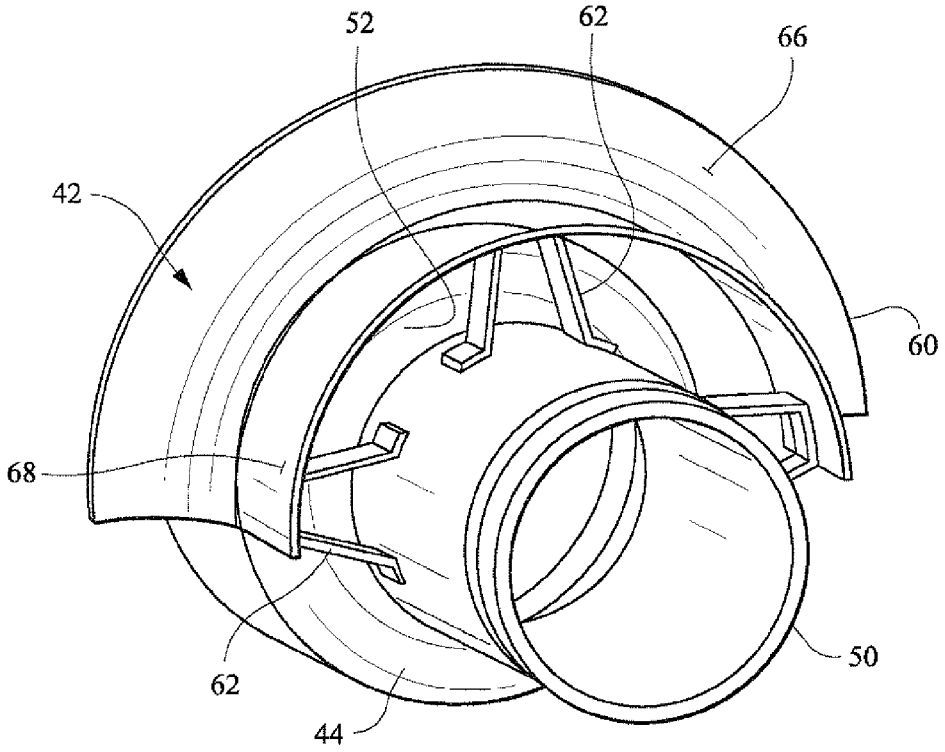
FIGS. 5 and 6 are front and rear perspective views of the turning guide mounted to a center body of a fuel nozzle assembly.
Figure 6:
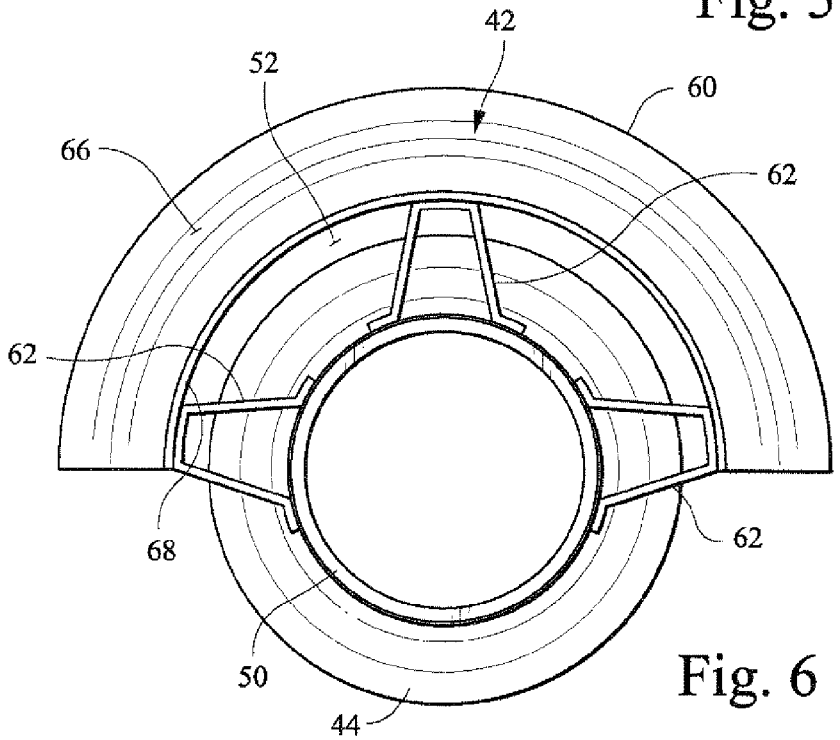

FIGS. 5 and 6 are a perspective view and a front view of a turning guide 42 mounted to the center body 50 of a fuel nozzle assembly. Support brackets 62 extend between the center body 50 and the turning guide 42. The support brackets may be pairs of legs arranged in a trapezoid. The legs may be planar and aligned with the air flowing between the turning guide and center body, such as an alignment with the axis of the fuel nozzle assembly. The rib support brackets 62 structurally support the turning guide in the duct 52.

The turning guide 42 may include an inlet portion 68 in the outlet region that is curved radially outward to conform to a desired flow path of air coming from the U-turn 38 shown in FIG. 2. The radially outer perimeter 60 of the inlet section may be at or radially beyond the same radial dimension as the inlet rim 58 of the shroud 46. The inlet portion 68 extends radially inward and joins a cylindrical outlet region 68 of the turning guide. The outlet region 68 extends in a direction parallel to the axis of the center body. The outlet region 68 may extend to and, optionally, into the shroud 46.

Figure 7:
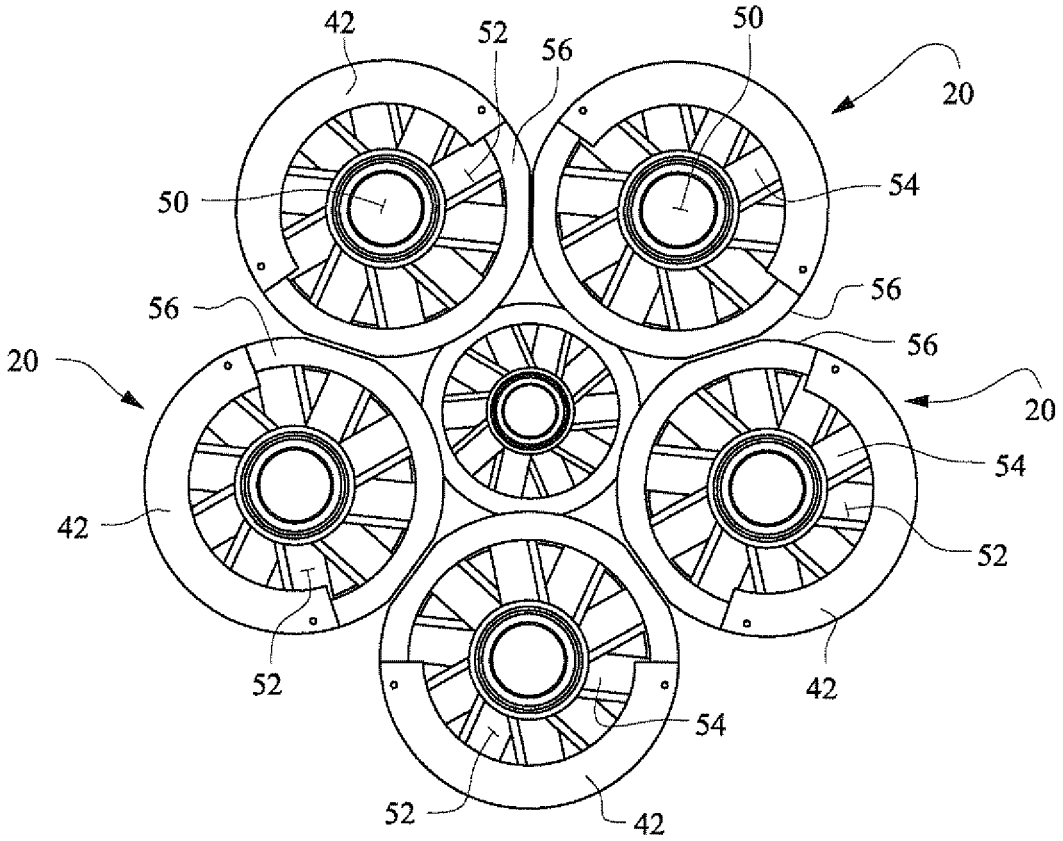
FIG. 7 is view of an array of fuel nozzle assemblies to show the orientation of the turning guides on the outer fuel nozzle assemblies.

FIG. 7 is an end view of a portion of an array of fuel nozzle assemblies 20, 30 in a combustion chamber showing the turning guides 42 at the inlet of the shrouds of the outer fuel nozzle assemblies 20. The half-circle turning guides 42 are mounted to the wide-mouth inlets 56 of the outer fuel nozzle assemblies 20. The turning guides 42 are oriented on each of the fuel nozzle assemblies 20 to face the U-shaped exit from which pressurized air exits the annular duct after having gone through a reversal of flow direction.

Figure 8:
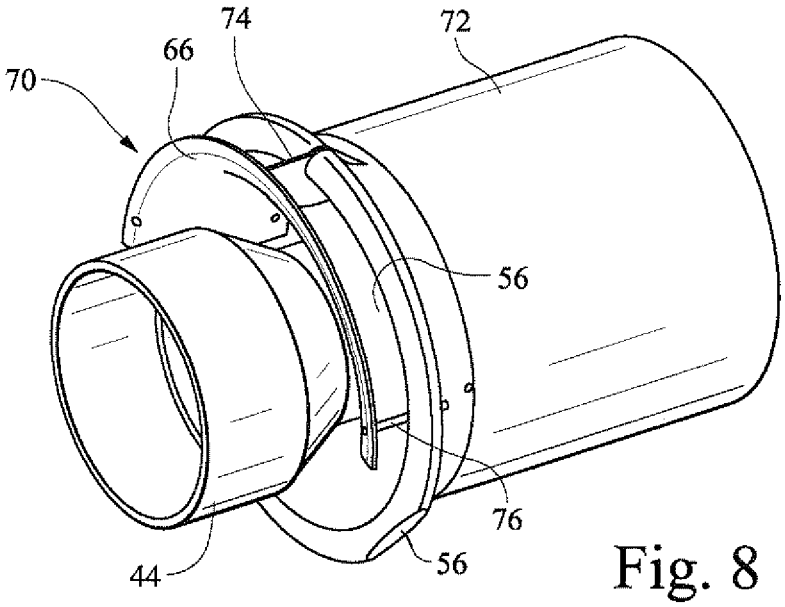
FIG. 8 is a perspective view of the side and back of a fuel nozzle assembly with a turning guide attached to a shroud.
Figure 9:
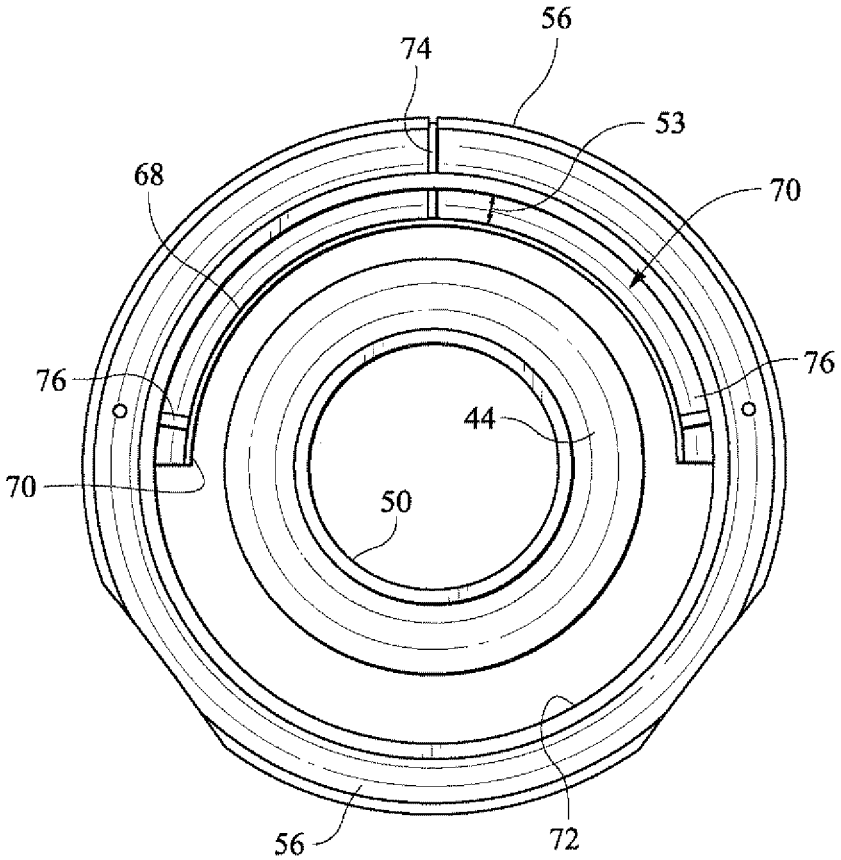
FIG. 9 is a cross-sectional view of the fuel nozzle assembly shown in FIG. 8, wherein the cross-section is along a plane perpendicular to an axis of the cross body.

FIGS. 8 and 9 are a perspective view and a front view, respectively, of a turning guide 70 mounted to the inlet of a shroud 72. The turning guide 70 is similar to the turning guide 42 except that the turning guide 70 is mounted to the shroud 72. The turning guide 70 is between the shroud 72, on the one side, and the rear collar 44 and center body 50 on the other side. The turning guide 70 may be attached and mounted to the wide mouth inlet 56 of the cylindrical shroud 72. The turning guide 70 and wide mouth 56 may be aligned with the junction between the collar 44 and the center body 50. The turning guide and wide mouth may be upstream of and slightly radially outward of the swirl vanes 54 between the center body and the shroud.

The turning guide may extend partially around the wide mouth inlet 56 as an arc, half-circle or other portion of circle. As illustrated in FIGS. 5 to 8, the turning guide 42, 70 extends half-way, e.g., 180 degrees, around the inside surface of the wide mouth. The turning guide may extend in an arc in a range of, for example, 200 degrees to 35 degrees.

The turning guide 70 may be formed of a ceramic or metal, and may be an integral component. The turning guide 70 may have an inlet section 66 that curves radially inwardly to the axis of the center body, and a cylindrical outlet section 68 that is straight along the axis.

The turning guide 70 may be attached to the shroud 72 by ribs 74 and posts 76 extending from the wide mount shroud inlet 56, through the gap 53 and to the curved inlet 66 of the turning guide. The rib may be aligned to be parallel to the axis of the center body to reduce air flow resistance through the gap 53. The rib 74 may be at the center of the turning guide and the posts 76 may be near the sides of the turning guide.

The turning guide 70 may be shaped to conform to the wide mouth inlet 56. The gap 64 formed between the turning guide 70 and the wide mouth inlet 56 may have a uniform width and be proximate to the radially outer region of the duct between the turning guide and wide mouth. The inlet to the gap may extend generally radially inward and turn axial at the discharge of the gap. The gap is the guided flow passage for a portion of the pressurized air entering the annular air passage between the shroud and the collar and center body.

Figure 11:
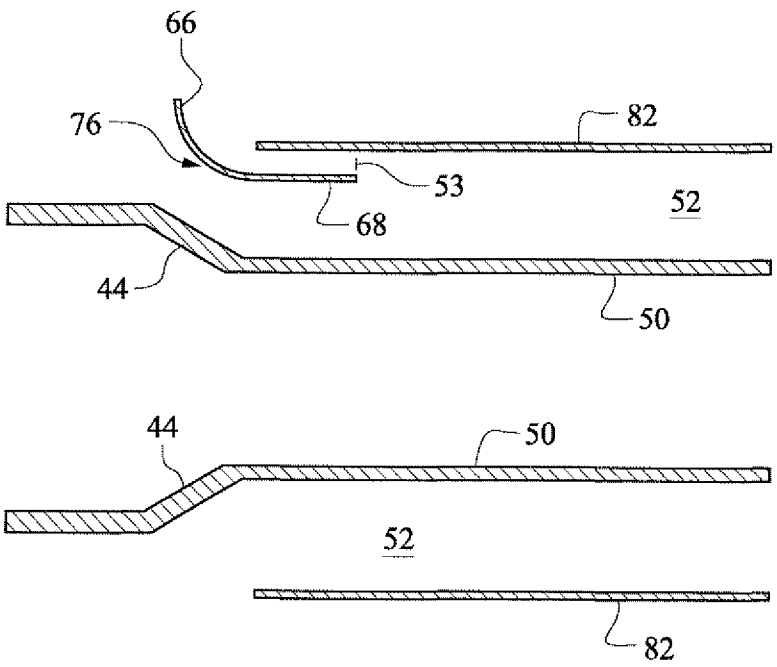
FIGS. 10 and 11 are schematic diagrams showing, in cross-section, a turning guide on shrouds with and without a bell-mouth inlet.
Figure 10:
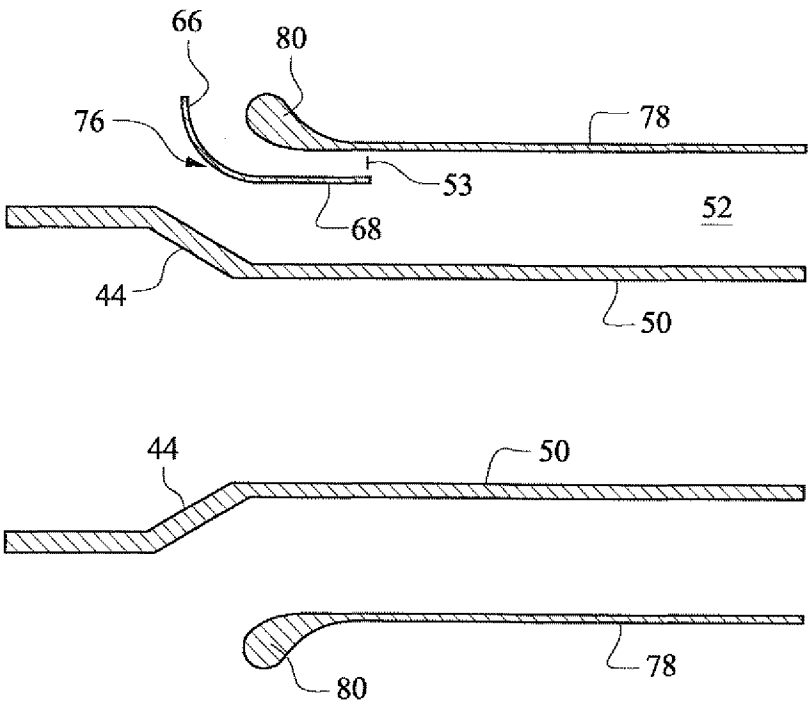

FIGS. 10 and 11 are cross-sectional schematic diagrams showing a turning guide 76 associated with a shroud 78 having a wide-mouth inlet 80 (FIG. 10) and a shroud 82 having a straight, cylindrical inlet. The curved inlet 66 of the turning guide conforms to the shape of the wide mouth inlet 80 for shroud 78, and does not conform to the cylindrical inlet of the shroud 82. The curved shape of the turning guide is intended to force the compressed air flowing from the U-turn in the doubled wall duct 36 towards the gap 53 and the radially outer region of duct 52. By forcing the air through the gap and towards the radially outer region of duct 52, the turning guide assists in making the flow velocity in duct 52 more uniform.

Figure 12:
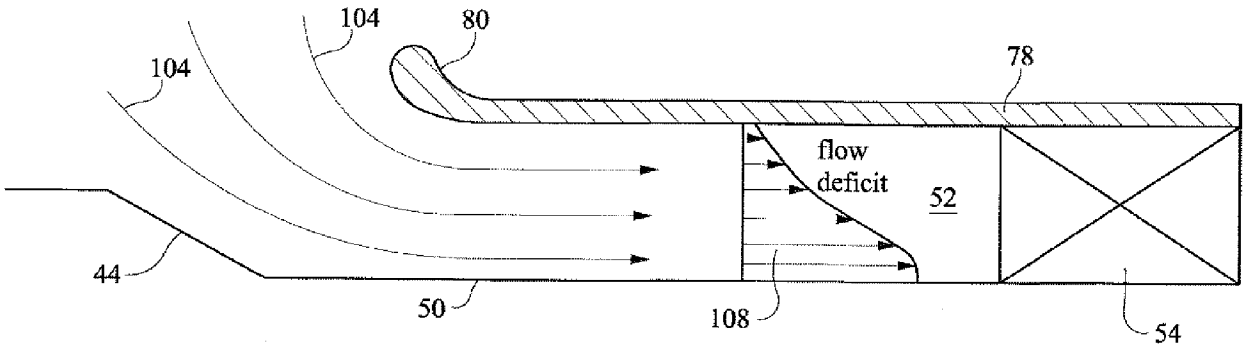
FIGS. 12 and 13 are views of the air flow through the duct with and without a turning guide.
Figure 13:
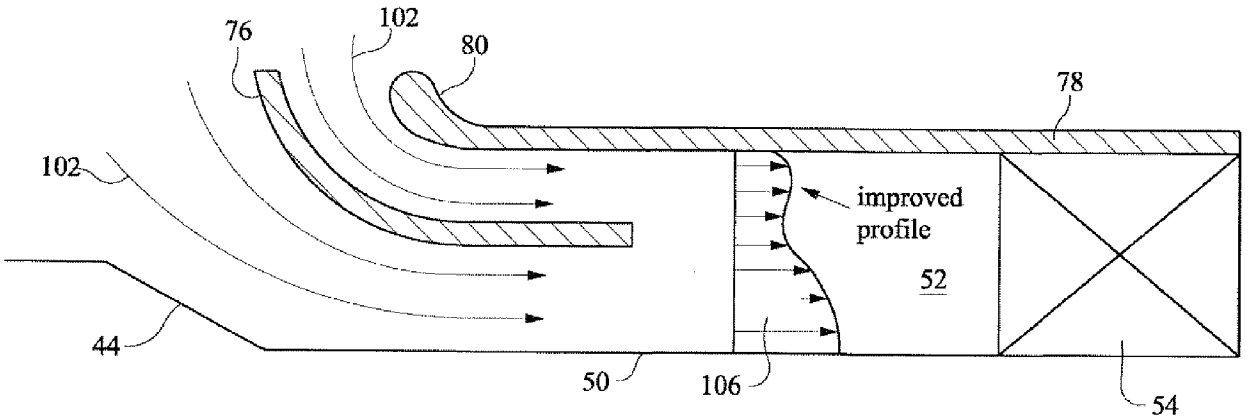

FIGS. 12 and 13 are views of the air flow through the duct 52 with (FIG. 13) and without (FIG. 11) a turning guide. The curved arrows 102 represent the air being turned by the turning guide 76 as the air enters the duct 52. The curved arrows 104 represent the air flowing into the duct 52 without being guided by a turning guide.

An air velocity profile 106 illustrates the generally uniform velocity of the air flow through the duct when a turning guide is at the inlet to the duct. The air velocity profile 108 shows the large variation in air velocity when a turning guide is not present. In particular, the air near the shroud 50 moves substantially slower than the air near the center body 78. As shown in FIGS. 12 to 14, the turning guide increases the air speed through radially outer region of the duct and thereby makes the airflow more uniform through duct.

The more uniform air velocity through the duct 52 resulting from the turning guide may provide advantages such as reduced NOx emissions from the combustion chamber, and an increase in steady flame performance of the chamber.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel nozzle assembly for a combustion chamber in a gas turbine, the assembly chamber comprising:

an end cover assembly;

fuel nozzle assemblies arranged around a center of the end cover assembly, wherein each fuel nozzle assembly includes:

a center body;

a shroud coaxial with and extending around the center body, and a turning guide having a downstream edge extending in a passage between the center body and an inlet to the shroud, wherein the turning guide extends only partially around the center body such that there is a semi-circular gap between ends of the turning guide and extending partially around the center body, wherein the fuel nozzle assembly is centered radially outward of an axis of the combustion chamber, the turning guide is positioned outward of the center body along a radial line extending from the axis, and the semi-circular gap is inward of the center body along the radial line extending from the axis.

2. The combustion chamber as in claim 1 wherein an air gap is between an inlet to the turning guide and the shroud.

3. The combustion chamber as in claim 1 wherein the turning guide is a thin sheet having a wide mouth curved inlet region and a generally straight outlet region aligned with an axis of the center body.

4. The combustion chamber as in claim 1 wherein the turning guide includes a wide mouth inlet and a cylindrical outlet.

5. The combustion chamber as in claim 1 wherein the turning guide is mounted to the shroud or center body.

6. The combustion chamber as in claim 1 wherein the turning guide extends in an arc around the fuel nozzle, and the arc is in a range of 200 degrees to 35 degrees.

7. The combustion chamber as in claim 1 wherein the turning guide is on a side of the shroud adjacent an outer annular flow duct through which compressor air passes and is turned radially inward towards the assembly.

8. A combustion chamber for a gas turbine comprising:

an annular flow duct through which pressurized air flows in a direction opposite to a flow of combustion gases formed in the chamber;

an end cover assembly having an inside surface and centered on an axis of the combustion chamber;

a radially inward turn in the flow duct proximate to the inside surface of the end cover assembly;

fuel nozzle assemblies arranged about the axis, wherein each fuel nozzle assembly includes:

a cylindrical center body, a cylindrical shroud coaxial with and extending around the center body, and a turning guide having an downstream edge extending in a passage between the center body and an inlet to the shroud, wherein the turning guide extends only partially around the center body, such that the turning guide is outward of the center body along a line extending from the axis and a semi-circular gap between ends of the turning guide and extending partially around the center body is between the center body and the axis, and the turning guide is aligned and proximate to an outlet of the annular flow duct such that the turning guide directs air from the annular flow duct into the passage between the center body and the shroud.

9. The combustion chamber of claim 8 wherein the turning guide is a thin sheet curved in an arc to conform to the center body.

10. The combustion chamber of claim 8 wherein the turning guide is a thin sheet having a curved inlet region and a generally straight, cylindrical outlet region.

11. The combustion chamber of claim 8 wherein the cylindrical shroud includes a wide mouth inlet section upstream of an inlet to the shroud and a cylindrical outlet region extending into the inlet to the shroud.

12. The combustion chamber of claim 8 wherein the turning guide is mounted to the shroud by a rib or post.

13. The combustion chamber of claim 8 wherein the turning guide extends in an arc around the fuel nozzle, and the arc is in a range of 200 degrees to 35 degrees.

14. The combustion chamber of claim 8 wherein the turning guide is on a side of the shroud adjacent the annular flow duct.

15. A method to direct pressurized air into a combustion chamber, the method comprising:

moving pressurized air in a first direction through an annular duct in the combustion chamber and turning the air radially inward from the duct towards fuel nozzle assemblies which are arranged around a center axis of the combustion chamber;

for each of the fuel nozzle assemblies, turning the pressurized air into a passage between a cylindrical shroud and a center body of the fuel nozzle assembly, and for each of the fuel nozzle assemblies, as the turned pressurized air flows into the passage, the air is directed by a turning guide having an inlet edge extending upstream of the cylindrical shroud and an outlet edge within the passage, wherein the turning guide extends only partially around the center body, such that the turning guide extends in an arc of 35 degrees to 200 degrees around the center body and is between the center body and the annular duct, and a semi-circular gap between ends of the turning guide crosses a line segment between the center body and the center axis of the combustion chamber.

16. The method of claim 15 wherein the turning guide is adjacent the outlet of the annular duct.

17. The method of claim 15 wherein the turning guide is proximate to the inlet to the shroud and the directed air is flowing near the inlet to the shroud.

18. The method of claim 15 wherein the turning guide increases a velocity of air flowing into a radially outward portion of the passage.

19. The method of claim 15 wherein the turning guide directs the turned air into a narrow gap between the turning guide and an inlet portion of the shroud.

20. The method of claim 19 wherein the inlet portion has a wide mouth and the turning guide directs the turned air into the narrow gap between the turning guide and the wide mouth of the shroud.

* * * * *

UNITED STATES PATENT AND TRADEMARK OFFICE

CERTIFICATE OF CORRECTION

PATENT NO. : 8,950,188 B2
APPLICATION NO. : 13/229115
DATED : February 10, 2015
INVENTOR(S) : Stewart It is certified that error appears in the above-identified patent and that said Letters Patent is hereby corrected as shown below:

In the claims

Column 8, line 11, Claim 15 --radially inward from the duct towards fuel nozzle assemblies--, should read "radially inward from the ducts towards the fuel nozzle assemblies"

Signed and Sealed this
Fifth Day of May, 2015

Michelle K. Lee

Michelle K. Lee
*Director of the United States Patent and Trademark Office*